US009816773B1

(12) United States Patent
Reis Green et al.

(10) Patent No.: US 9,816,773 B1
(45) Date of Patent: Nov. 14, 2017

(54) SPRING DETENT RETAINED END CAP FOR A FIREARM SUPPRESSOR

(71) Applicants: Austin Reis Green, Dousman, WI (US); Evan Reis Green, Dousman, WI (US)

(72) Inventors: Austin Reis Green, Dousman, WI (US); Evan Reis Green, Dousman, WI (US)

( * ) Notice: Subject to any disclaimer, the term of this patent is extended or adjusted under 35 U.S.C. 154(b) by 0 days.

(21) Appl. No.: 15/392,315

(22) Filed: Dec. 28, 2016

Related U.S. Application Data

(63) Continuation-in-part of application No. 15/343,648, filed on Nov. 4, 2016.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/325; F41A 21/34; F41A 21/36; F41A 21/32; F41A 21/40
See application file for complete search history.

(56) References Cited

U.S. PATENT DOCUMENTS 4,632,437 A * 12/1986 Robson ..... F16L 37/101 285/243
5,356,183 A * 10/1994 Cole ..... F16L 25/0045 285/148.27
6,168,212 B1 * 1/2001 Finley ..... F16B 7/1427 285/302
7,661,349 B1 * 2/2010 Brittingham ..... F41A 21/30 181/223
7,676,976 B2 * 3/2010 Dueck ..... F41A 21/30 42/90
7,743,693 B1 * 6/2010 Brittingham ..... F41A 21/325 89/14.2
7,789,009 B1 * 9/2010 Brittingham ..... F41A 21/30 181/223
7,856,914 B2 12/2010 Shults et al.
8,096,222 B2 1/2012 Silvers
8,424,441 B2 * 4/2013 Brittingham ..... F41A 21/26 181/223
8,459,406 B1 * 6/2013 Dueck ..... F41A 21/30 181/223
8,499,676 B1 * 8/2013 Moore ..... F41A 21/325 42/90
8,584,794 B2 * 11/2013 Dueck ..... F41A 21/30 181/223
8,881,862 B1 11/2014 Messer, Jr. et al.
8,973,481 B2 * 3/2015 Dueck ..... F41A 21/325 181/223

(Continued)

*Primary Examiner* — Benjamin P Lee
(74) *Attorney, Agent, or Firm* — Dunlap Bennett & Ludwig PLLC

(57) ABSTRACT

A wire spring retained end cap for a firearm sound suppressor is provided. The discharge end of the firearm sound suppressor has a notched internal bore and a female threaded portion that receives a threaded male portion of the end cap. The threaded end cap has a channel and wire spring disposed within the channel. The wire spring biases a detent within one of the notches of the internal bore, thereby preventing the end cap from loosening during use of the firearm sound suppressor. The end cap is easily removed to clean or service the firearm sound suppressor.

10 Claims, 3 Drawing Sheets

(56) References Cited

U.S. PATENT DOCUMENTS

| | | | | |
|---|---|---|---|---|
| 9,163,891 | B1 * | 10/2015 | Dater | F41A 21/34 |
| 9,239,201 | B1 | 1/2016 | Reis Green | |
| 9,464,857 | B2 * | 10/2016 | Lessard | F41A 21/34 |
| 9,631,888 | B2 * | 4/2017 | Young | F41A 21/325 |
| 2010/0139145 | A1 * | 6/2010 | Brittingham | F41A 21/325 42/90 |
| 2010/0257996 | A1 * | 10/2010 | Noveske | F41A 21/34 89/14.2 |
| 2012/0180623 | A1 * | 7/2012 | Graham, II | F41A 21/325 89/14.4 |
| 2014/0237881 | A1 * | 8/2014 | Mack | F41A 21/325 42/90 |

* cited by examiner

SPRING DETENT RETAINED END CAP FOR A FIREARM SUPPRESSOR

CROSS-REFERENCE TO RELATED APPLICATION

This application is a continuation in part of U.S. non-provisional application Ser. No. 15/343,648, filed Nov. 4, 2016, the contents of which are herein incorporated by reference.

BACKGROUND OF THE INVENTION

The present invention relates to a lockable end cap for a firearm suppressor and, more particularly, to a spring detent retained end cap for a firearm suppressor.

Despite the popularity of current firearm suppressors, several problems remain. Many end caps are welded to the firearm suppressor body, which makes the cleaning of the internals very difficult or impossible. Some firearm suppressors include threaded end caps releasably securable to internal threads of the firearm suppressor body. The threaded end caps loosen in as few as five to ten shots fired due to vibration. Further, the threaded end caps of mono baffle designs become lead and copper brazed to the tube, which requires increased torque to remove the end cap, and potentially prevents a user from removing the end cap and cleaning the firearm suppressor.

Most rifle suppressor end caps are structural components which retain the baffles and internal components in the distal bore of the suppressor. Some include two components, one of which is a spanner that provides structural retention of the internal components, and the other which comprises an ornamental end cap which functions solely as an end plate. When an ornamental end cap is used, generally the cap mates via threads to the structural retaining spanner which is welded into the suppressor tube body, rendering the end cap replaceable, but preventing the user from accessing internal components for cleaning and maintenance. In some cases, the end cap is threaded with permanent thread sealant which also prevents access to the internals. In a few cases, the structural cap is connected via threads and may include an O-ring to help retain the cap to the assembly. O-rings are rated for service up to approximately 400° F. Rifle suppressors exceed 400° F. after fifteen to twenty rounds fired. Since O-rings have temperature limitations, the O-rings are ill-suited for use with general purpose, centerfire rifle sound suppressors.

As can be seen, there is a need for an improved mechanical device for retaining threaded end caps to a firearm suppressor body.

SUMMARY OF THE INVENTION

In one aspect of the present invention, a firearm suppressor comprises: a cylindrical body comprising an inner surface forming an internal bore, a first end comprising a receiving bore, and a second end, wherein a female threaded portion and at least one notch are formed on the inner surface of the second end; an end cap comprising a discharge bore and a male threaded portion mechanically fastened to the female threaded portion; and a spring disposed within the end cap, wherein the spring biases a rounded detent radially from the end cap into at least one notch.

In another aspect of the present invention, a firearm suppressor comprises: a cylindrical body comprising an inner surface forming an internal bore, a first end comprising a receiving bore, and a second end, wherein a female threaded portion and at least one rounded notch are formed on the inner surface of the second end; an end cap comprising a gripping portion comprising a discharge bore, a male threaded portion extending from the gripping portion, wherein a channel is formed circumferentially about an outer surface of the end cap in between the male threaded portion and the gripping portion, wherein the male threaded portion is mechanically fastened to the female threaded portion of the cylindrical body; and an elongated wire spring disposed within the channel and comprising a first end and a second end, wherein the first end comprises a rounded detent formed by a first bend in the elongated wire spring, wherein the rounded detent is spring biased radially from the end cap and into at least one rounded notch.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a lockable, but easily removable threaded end cap for a firearm suppressor having a plurality of baffles or other internals contained within. The firearm suppressor includes a cylindrical housing which attaches to the distal end of the gun barrel. The baffles or other internals function to reduce pressure, temperature, and velocity of propellant gases in order to suppress firearm muzzle blast. These propellant gasses generate pressure waves that cause prior art threaded end caps to loosen, causing safety and reliability issues. The gasses also contain residues of carbon, lead, copper, and in some cases molybdenum, which can condense on the surfaces of baffles and other internals. These deposits are thermally adhesive in nature, add weight and reduce volume, thereby reducing the sound performance of the suppressor. The present invention prevents the end cap from loosening and allows the user to easily remove the end cap to clean the residue deposits from the firearm suppressor.

The present invention includes a novel wire spring and threaded removable notched and grooved end cap assembly. The wire spring and threaded, notched and grooved end cap does not loosen while the suppressor is being used, and can be easily disassembled by removing the end cap with a hand tool to allow removal of the baffles from the discharge end bore. After cleaning, the reassembly is easily accomplished in reverse order.

The wire spring retained end cap is an improvement on prior art for general purpose rifle suppressor use. The wire spring end cap provides the replaceable ornamental end cap function, and also provides the structural end cap functionality, without resorting to welds or permanent assembly methods. The wire spring retained end cap provides service to approximately 1200° F., which is above temperatures attained during general purpose use, and three times higher than the O-rings used in prior art suppressors. Further, the present invention allows desirable end user disassembly and access to internal components, affording the end user the ability to clean, and field service the sound suppressor.

Figure 1:
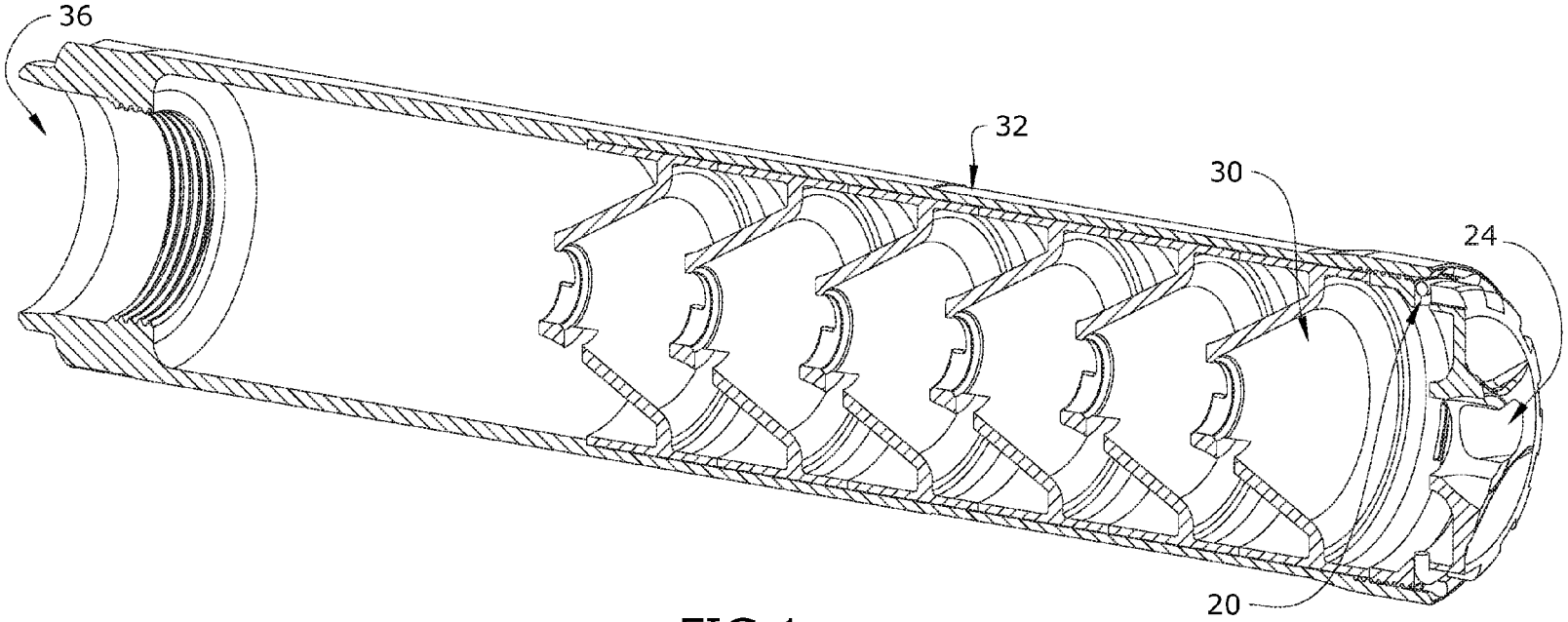
FIG. 1 is a section view of an embodiment of the present invention.
Figure 2:
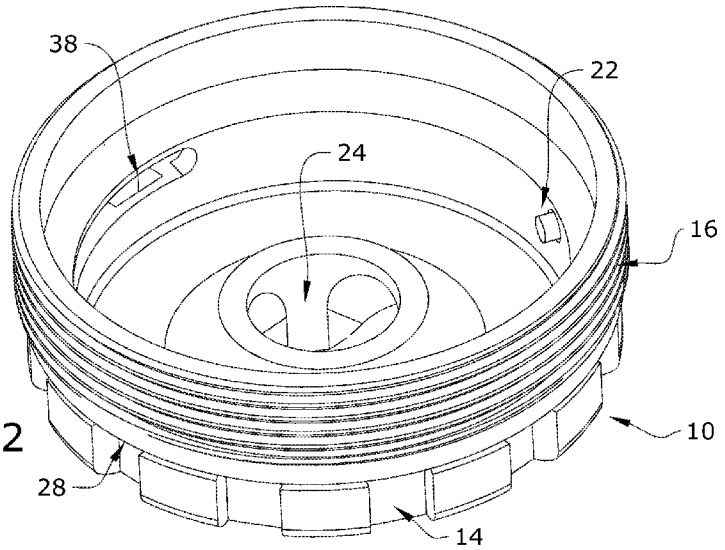
FIG. 2 is a perspective view of an embodiment of the present invention.
Figure 3:
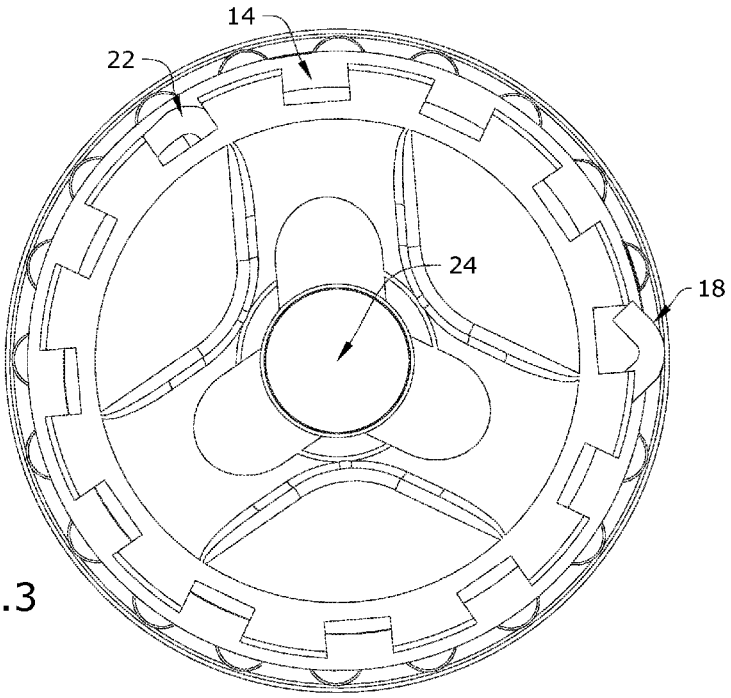
FIG. 3 is a front view of an embodiment of the present invention.
Figure 4:
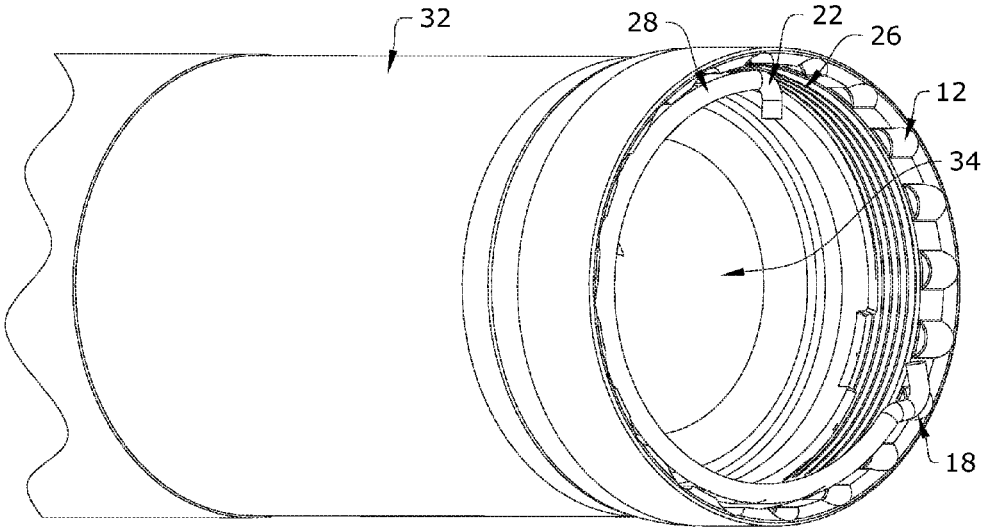
FIG. 4 is a perspective detail view of an embodiment of the present invention.
Figure 5:
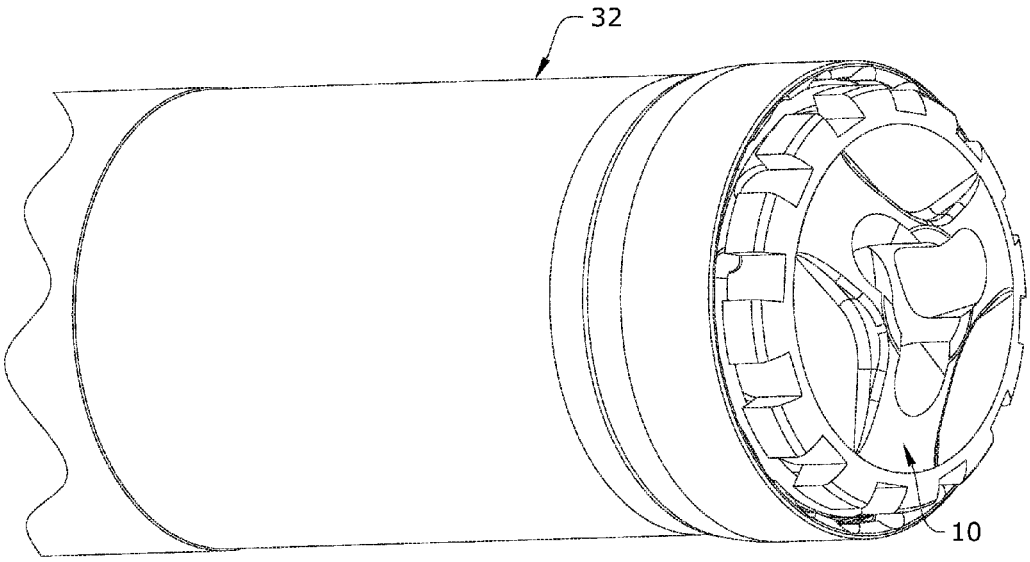
FIG. 5 is a perspective detail view of an embodiment of the present invention.

Referring to FIGS. 1 through 5, the present invention includes a firearm suppressor. The firearm suppressor includes a cylindrical body 32 having an inner surface forming an internal bore, a first end including a receiving bore 36 and a second end forming an opening 34. A female threaded portion 26 and at least one notch 12 are formed on the inner surface of the second end. The present invention further includes an end cap 10 having a male threaded portion 16. A discharge bore 24 is formed through the end cap 10. The male threaded portion 16 mechanically fastens to the female threaded portion 26 of the cylindrical body 32. A spring 28 is disposed within the end cap 10. The spring 28 biases a rounded detent 18 radially from the end cap 10 into the notch 12, thereby preventing the end cap 10 from loosening by vibrations caused by propellant gasses.

The cylindrical body 32 includes a tube made of a material with a high strength to weight ratio such as aluminum, titanium, stainless steel and the like. In certain embodiments, the present invention may be made of 17-4 PH, which is stainless steel that provides a substantial increase in strength without excessive weight and is relatively low in cost.

In certain embodiments, at least one notch 12 includes a plurality of notches 12 disposed circumferentially about the inner surface of the second end of the cylindrical body 32. Each of the notches 12 may include cut out portions of an inner edge of the second end of the cylindrical tube. The notches 12 may be rounded, and may include a half pipe shape. The plurality of notches 12 may be disposed about the entire circumference of the inner surface at an even distance between one another. Therefore, the end cap 10 may be screwed onto the cylindrical body 32 from any position and the rounded detent 18 may be biased into one of the plurality of notches 12 once the end cap 10 is fully screwed into the second end of the cylindrical body 32.

A plurality of baffles 30 or other noise suppressants maybe be disposed within the cylindrical body 32. In certain embodiments, each of the baffles 30 of the present invention may include a frusto-conical sidewall. The frusto-conical sidewall includes an apex having an axial bore and a base opposite the apex. The apex is disposed towards the receiving bore 36 and the base is disposed toward the discharge bore 24. In certain embodiments, the baffles 30 may be removable from the cylindrical body 32. A ledge is formed on the inner surface of the cylindrical body 32. The base of the baffle 30 nearest the first end of the cylindrical body 32 abuts against the ledge. The baffles 30 are stacked within cylindrical body 32, with the end cap 10 abutting the baffle 30 nearest to the second end 34 of the cylindrical body 32. To remove the baffles 30 for cleaning, the end cap 10 is unscrewed from the second end of the cylindrical body 32 and the baffles 30 slide out of the cylindrical body 32.

The end cap 10 of the present invention may include a gripping portion and the male threaded portion 16 extending from the gripping portion. A plurality of notches 14 may be formed circumferentially about the outer surface of the gripping portion. The notches 14 may be squared notches 14. A tool having a plurality of squared protrusions fit within the squared notches 14 and may thereby interlock with the squared notches 14. The tool may be rotated to fasten and unfasten the end cap 10 to the cylindrical body 32. The squared notches 14 also allow the spring 28 to be in contact with the outside air, keeping the spring 28 relatively cool.

In certain embodiments, the spring 28 includes an elongated wire spring 28 having a first end and a second end 22. The elongated wire spring 28 may be a flexible metal wire. The first end includes the rounded detent 18 formed by two bends in the elongated wire spring 28 forming a curved protrusion. The second end 22 includes a single bend. The bend may be about 90 degrees. The second end 22 is disposed within an aperture formed through the end cap 10. A channel 20 is formed circumferentially about an outer surface of the end cap 10 in between the male threaded portion 16 and the gripping portion. The elongated wire spring 28 is disposed within the channel 20 and thereby wraps around a portion of the end cap 10. The elongated wire spring 28 may include a round cross section which minimizes contact with the annular channel 20. The end cap 10 may further include a radial slot 38 formed below a portion of the channel 20 that houses the first end of the elongated wire spring 28. Therefore, the rounded detent 18 may be pushed into the radial slot 38 when transferring from one notch 12 to the next.

Using the present invention, the elongated wire spring 28 in conjunction with notches 12 and rounded detent 18 prevents vibration from rotating the end cap 10 and thereby loosen the end cap 10. The present invention stays tightly attached to the cylindrical body 32 during extended use in the field. The present invention prevents rotation but allows the end cap 10 to be easily removed to provide the user with the ability to thoroughly clean and maintain the suppressor.

It should be understood, of course, that the foregoing relates to exemplary embodiments of the invention and that modifications may be made without departing from the spirit and scope of the invention as set forth in the following claims.

What is claimed is:

1. A firearm suppressor comprising:

a cylindrical body comprising an inner surface forming an internal bore, a first end comprising a receiving bore, and a second end, wherein a female threaded portion and at least one notch are formed on the inner surface of the second end;

an end cap comprising a discharge bore and a male threaded portion mechanically fastened to the female threaded portion; and a spring disposed within the end cap, the spring comprising a rounded detent protruding radially from the end cap into the at least one notch.

2. The firearm suppressor of claim 1, wherein the at least one notch comprises a plurality of notches disposed circumferentially about the inner surface of the second end, wherein the rounded detent is disposed within one of the plurality of notches.

3. The firearm suppressor of claim 1, wherein the spring comprises an elongated wire spring comprising a first end and a second end, wherein the first end comprises the rounded detent formed by a first bend in the elongated wire spring.

4. The firearm suppressor of claim 3, wherein the second end of the spring comprises a second bend, wherein the second end is disposed within an aperture formed through the end cap.

5. The firearm suppressor of claim 3, wherein the end cap comprises a gripping portion and the male threaded portion extending from the gripping portion.

6. The firearm suppressor of claim 5, wherein a channel is formed circumferentially about an outer surface of the end cap in between the male threaded portion and the gripping portion, wherein the elongated wire spring is disposed within the channel.

7. The firearm suppressor of claim 5, further comprising a plurality of squared notches formed circumferentially about the outer surface of the gripping portion.

8. The firearm suppressor of claim 6, wherein the end cap further comprises a radial slot formed below a portion of the channel that houses the first end of the elongated wire spring.

9. A firearm suppressor comprising:

a cylindrical body comprising an inner surface forming an internal bore, a first end comprising a receiving bore, and a second end, wherein a female threaded portion and at least one rounded notch are formed on the inner surface of the second end;

an end cap comprising a gripping portion comprising a discharge bore, a male threaded portion extending from the gripping portion, wherein a channel is formed circumferentially about an outer surface of the end cap in between the male threaded portion and the gripping portion, wherein the male threaded portion is mechanically fastened to the female threaded portion of the cylindrical body; and an elongated wire spring disposed within the channel and comprising a first end and a second end, wherein the first end comprises a rounded detent formed by a first bend in the elongated wire spring, wherein the rounded detent protrudes radially from the end cap and into the at least one rounded notch.

10. The firearm suppressor of claim 9, wherein the at least one rounded notch comprises a plurality of rounded notches disposed circumferentially about the inner surface of the second end of cylindrical body, wherein the rounded detent is disposed within one of the plurality of rounded notches.

* * * * *